US012317932B2

(12) United States Patent
Zhou et al.

(10) Patent No.: US 12,317,932 B2
(45) Date of Patent: Jun. 3, 2025

(54) ATOMIZER AND ELECTRONIC ATOMIZING DEVICE HAVING THE SAME

(71) Applicant: Jiangmen Moore Technology.,Ltd, Jiangmen (CN)

(72) Inventors: Weidong Zhou, Jiangmen (CN); Fengwen Lu, Jiangmen (CN); Min Wang, Jiangmen (CN); Xiaoan Zhu, Jiangmen (CN)

(73) Assignee: Jiangmen Moore Technology., Ltd, Jiangmen (CN)

( * ) Notice: Subject to any disclaimer, the term of this patent is extended or adjusted under 35 U.S.C. 154(b) by 251 days.

(21) Appl. No.: 17/562,450

(22) Filed: Dec. 27, 2021

(65) Prior Publication Data

US 2022/0202093 A1 Jun. 30, 2022

(30) Foreign Application Priority Data

Dec. 30, 2020 (CN) ..... 202023303669.8

(51) Int. Cl.

| | |
|---|---|
| ***A24F 40/485*** | (2020.01) |
| ***A24F 40/10*** | (2020.01) |
| ***A24F 40/44*** | (2020.01) |
| ***A24F 40/46*** | (2020.01) |

(52) U.S. Cl.

CPC ..... *A24F 40/485* (2020.01); *A24F 40/10* (2020.01); *A24F 40/44* (2020.01); *A24F 40/46* (2020.01)

(58) Field of Classification Search

None

See application file for complete search history.

(56) References Cited

U.S. PATENT DOCUMENTS

| | | | | |
|---|---|---|---|---|
| 2015/0296888 | A1* | 10/2015 | Liu | A24F 40/60 131/329 |
| 2020/0397046 | A1* | 12/2020 | Lin | A24F 40/30 |
| 2023/0210175 | A1* | 7/2023 | Lei | A24F 40/40 131/329 |

FOREIGN PATENT DOCUMENTS

| | | | |
|---|---|---|---|
| CN | 109393570 | A | 3/2019 |
| CN | 111134364 | A | 5/2020 |
| CN | 211211432 | U | 8/2020 |
| CN | 211910515 | U | 11/2020 |
| EP | 3563700 | A1 | 11/2019 |
| EP | 3569073 | A1 | 11/2019 |

(Continued)

OTHER PUBLICATIONS

European Search Report for European Patent Application No. 21217925.3 mailed Jun. 20, 2022.

(Continued)

*Primary Examiner* — Philip Y Louie
*Assistant Examiner* — Nicole A Szumigalski
(74) *Attorney, Agent, or Firm* — Dorsey & Whitney LLP

(57) ABSTRACT

The present disclosure relates to an atomizer and an electronic atomizing device. The atomizer includes a base, a sealing member, an atomizing core and a flow guiding member. The sealing member is arranged between the base and the atomizing core. The base is provided with an air inlet channel, and the sealing member is provided with a directing hole configured to guide air to the atomizing core. Taking a plane perpendicular to an axial direction of the atomizer as a reference plane, a distance between orthographic projections of the flow guiding member and the directing hole on the reference plane is greater than zero.

8 Claims, 14 Drawing Sheets

(56) References Cited

FOREIGN PATENT DOCUMENTS

| | | | | |
|---|---|---|---|---|
| WO | 2016154994 | A1 | 10/2016 | |
| WO | 2020224590 | A1 | 11/2020 | |
| WO | WO-2022052063 | A1 * | 3/2022 | ..... A24F 40/10 |

OTHER PUBLICATIONS

European Search Report for European Patent Application No. 21218010.3 mailed Jun. 20, 2022.
Non-Final Office Action for U.S. Appl. No. 17/562,484 mailed Jan. 10, 2023.
Notification of Correction for Chinese Application No. CN202023303669.8 dated Sep. 14, 2021.

* cited by examiner

ATOMIZER AND ELECTRONIC ATOMIZING DEVICE HAVING THE SAME

CROSS-REFERENCE OF RELATED APPLICATION

The present disclosure claims the priority of a Chinese patent application 202023303669.8, filed on Dec. 30, 2020, and entitled "ATOMIZER AND ELECTRONIC ATOMIZING DEVICE", the entire content of which is incorporated herein by reference.

TECHNICAL FIELD

The present disclosure relates to the technical field of atomization, in particular to an atomizer and an electronic atomizing device including the atomizer.

BACKGROUND

The electronic atomizing device generally includes an atomizer and a power supply. When the electronic atomizing device is not in use, the liquid or condensate in the atomizer may leak from the atomizer to the power supply, such that the leaking liquid or condensate erodes the power supply, thereby affecting the service life of the power supply.

SUMMARY

According to various exemplary embodiments, the present disclosure provides an atomizer and an electronic atomizing device including the same.

An atomizer includes an atomizing core; a base provided with an air inlet channel; a sealing member located between the base and the atomizing core, the sealing member being provided with a directing hole configured to guide air into the atomizing core; and a flow guiding member connected to the sealing member; wherein taking a plane perpendicular to an axial direction of the atomizer as a reference plane, a distance between orthographic projections of the flow guiding member and the directing hole on the reference plane is greater than zero.

Details of one or more embodiments of the present disclosure will be given in the following description and attached drawings. Other features, objects and advantages of the present disclosure will become apparent from the description, drawings, and claims.

DETAILED DESCRIPTION OF THE EMBODIMENTS

Figure 1:
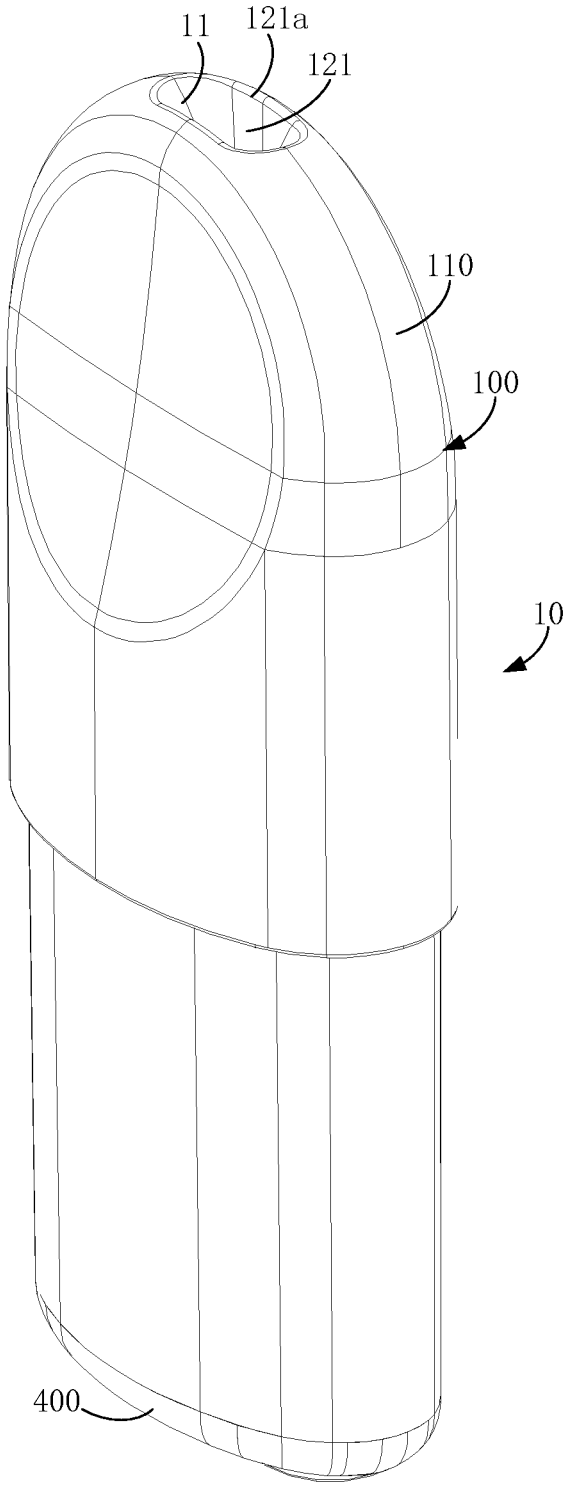
FIG. 1 is a perspective view of an atomizer according to an embodiment.

In order to facilitate the understanding of the present disclosure, the present disclosure will be described in a more comprehensive manner with reference to the relevant drawings. Exemplary embodiments of the present disclosure are shown in the drawings. However, the present disclosure can be implemented in many different forms and is not limited to the embodiments described herein. On the contrary, the purpose of providing these embodiments is to make the disclosure of the present disclosure more thorough and comprehensive.

It should be noted that when an element is referred to as being "fixed to" another element, it can be directly on another element or an intermediate element may also be present. When an element is considered to be "connected to" another element, it can be directly connected to another element or an intermediate element may be present at the same time. Terms "inner", "outer", "left", "right" and similar expressions used herein are for illustrative purposes only, and do not mean that they are the only embodiments.

Figure 2:
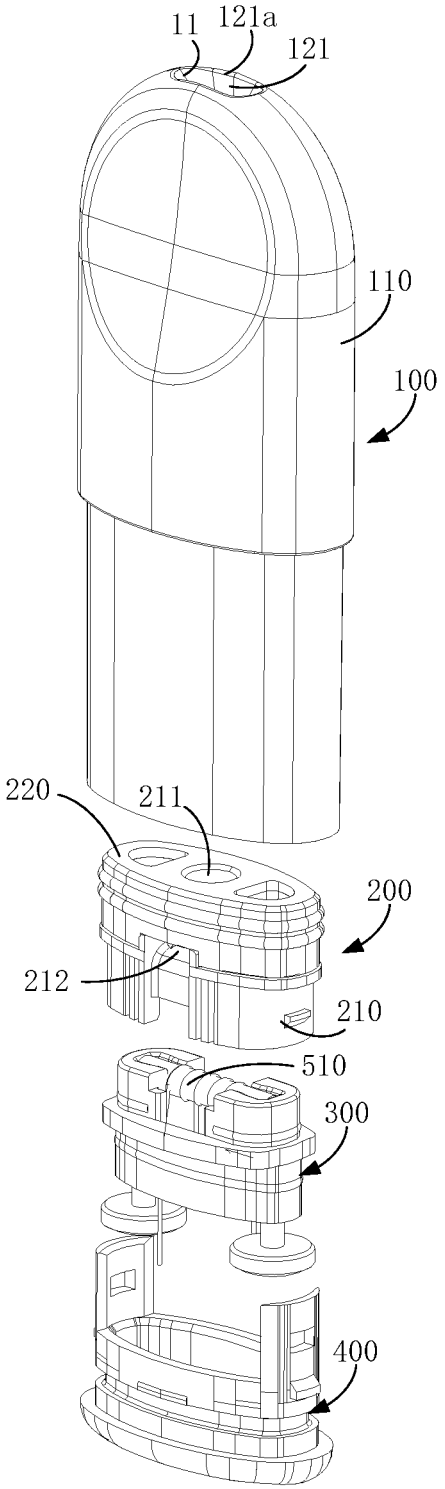
FIG. 2 is an exploded view of the atomizer shown in FIG. 1.
Figure 3:
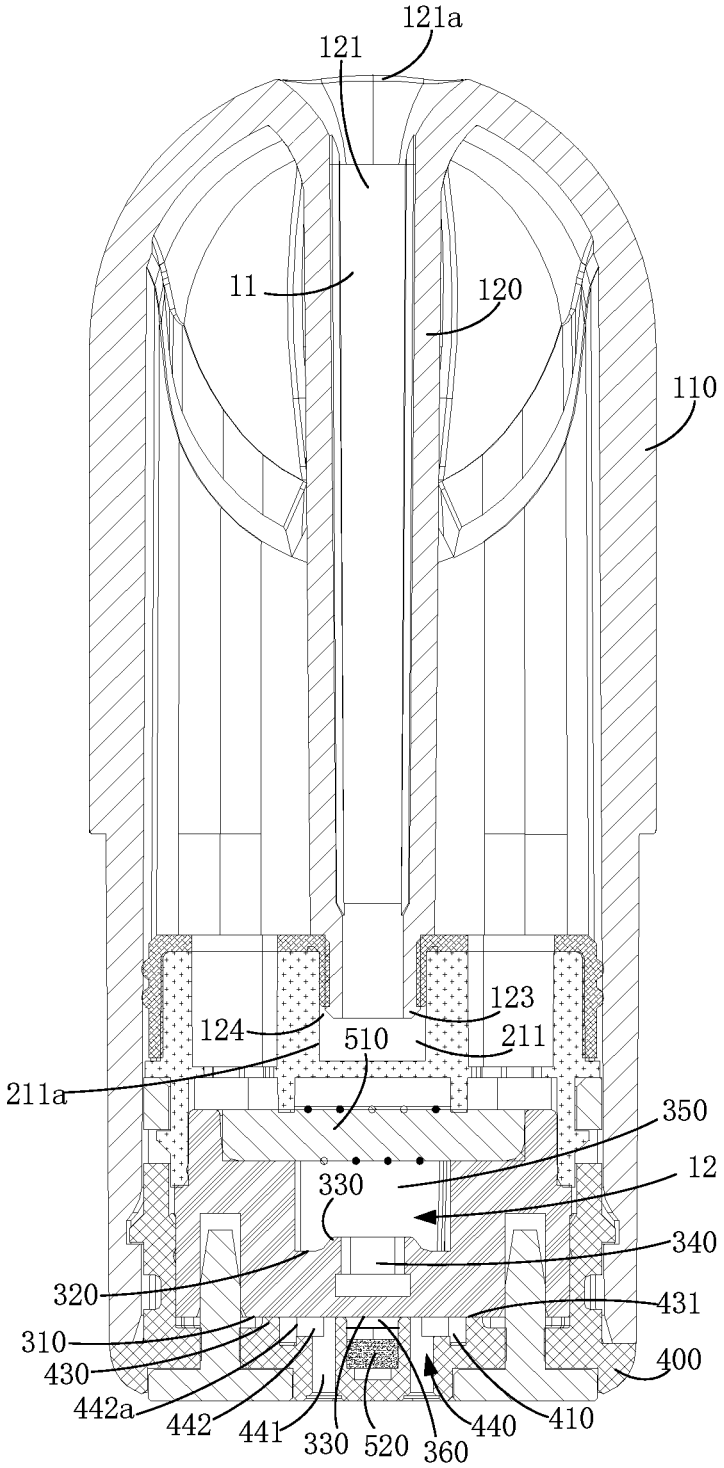
FIG. 3 is a plan cross-sectional view of the atomizer shown in FIG. 1 in a first direction.

Referring to FIGS. 1, 2 and 3, an electronic atomizing device according to an embodiment of the present disclosure includes an atomizer 10 and a power supply (not labeled). The atomizer 10 is detachably and electrically connected to the power supply. In other embodiments, the atomizer 10 and the power supply can also be packaged in the same housing, and cannot be detached from each other. The power supply can supply power to the atomizer 10. The atomizer 10 converts electrical power into heat, so as to atomize liquid in the atomizer 10 to form an aerosol that can be inhaled by the user. The liquids can be e-liquid and other aerosol generating substrates.

The atomizer 10 includes a housing 100, a top cover assembly 200, a sealing member 300, a flow guiding member 360, a base 400, an atomizing core 510, and a liquid absorbing member 520.

Figure 4:
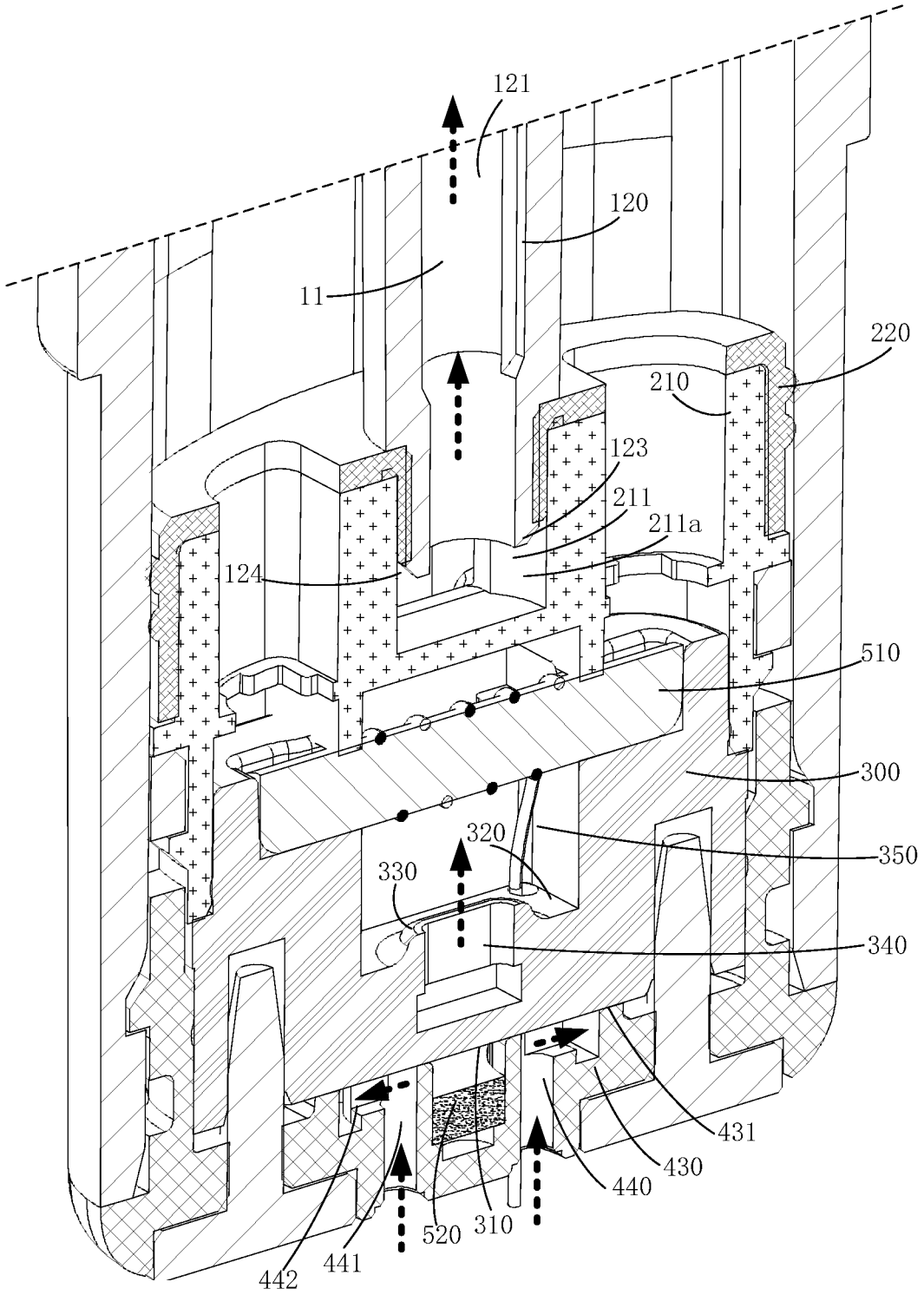
FIG. 4 is a perspective cross-sectional view of the atomizer shown in FIG. 1 in a first direction.
Figure 5:
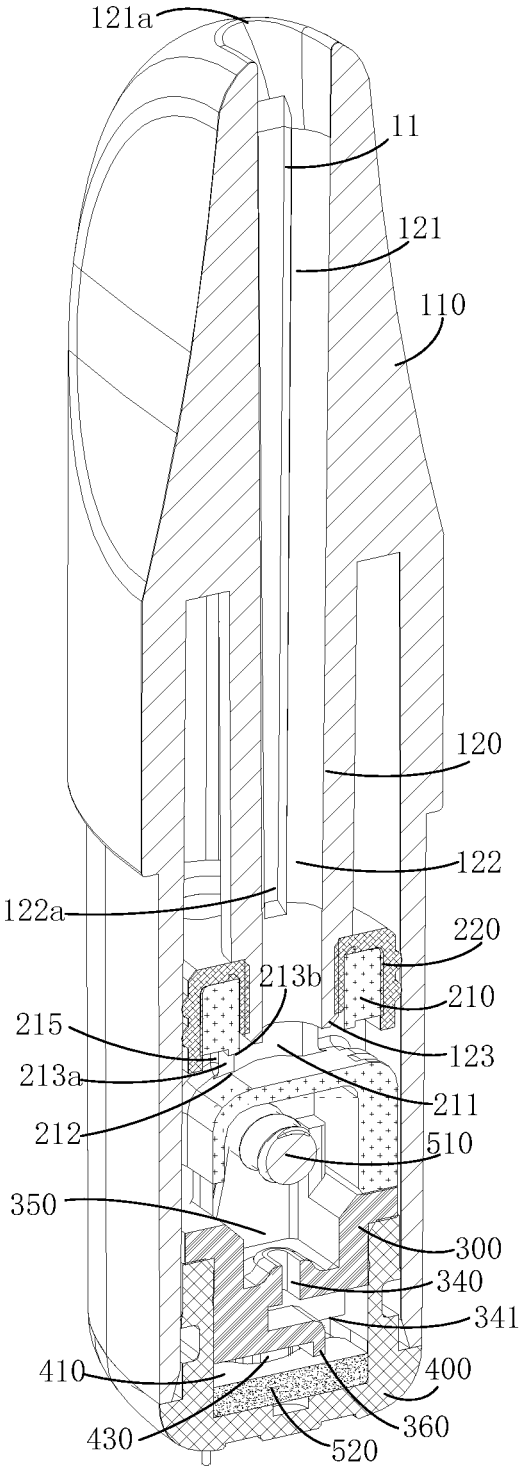
FIG. 5 is a perspective cross-sectional view of the atomizer shown in FIG. 1 in a second direction.

Referring to FIGS. 3, 4 and 5, the housing 100 includes a shell 110 and a central post 120. The central post 120 is connected to the housing 110 and is located in a cavity enclosed by the shell 110. The central post 120 is provided with an inhaling hole 121 therein. An upper end of the inhaling hole 121 forms a nozzle 121*a*. The nozzle 121*a* is in a direct fluid communication with an outside atmosphere, thus the user can inhale the aerosol at the nozzle 121*a*. The central post 120 includes a tip portion 123 provided away from the nozzle 121*a*. A cross-sectional size of the tip portion 123 gradually decreases in a direction from top to bottom, such that the tip portion 123 is substantially frustum-shaped. The central post 120 has a second inner surface 122 that defines a boundary of the inhaling hole 121. The second inner surface 122 is recessed to form a receiving groove 122*a*. The receiving groove 122*a* extends along a central axis of the inhaling hole 121.

Figure 6:
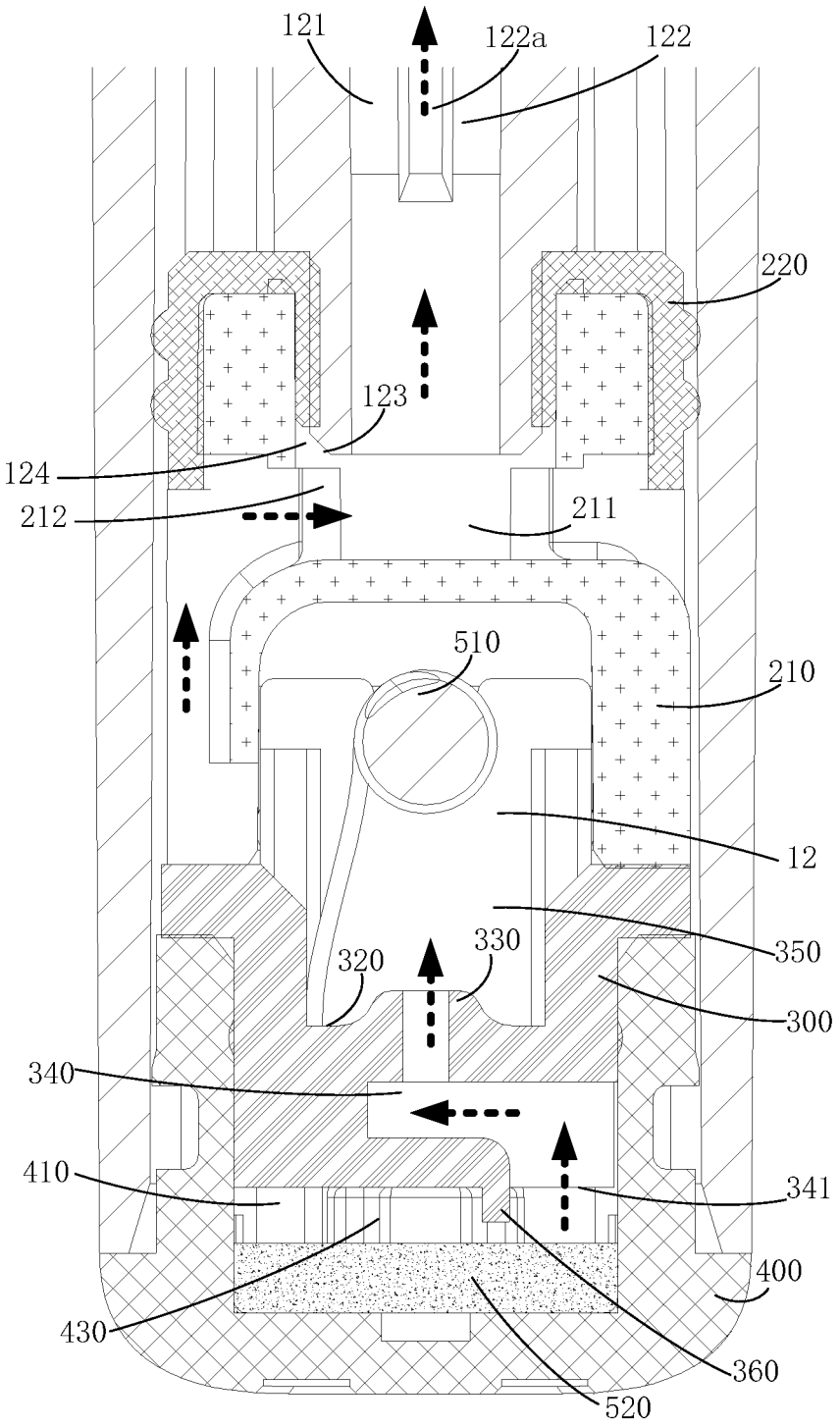
FIG. 6 is a plan cross-sectional view of the atomizer shown in FIG. 1 in a second direction.

Referring to FIGS. 4, 5 and 6, the top cover assembly 200 is provided in the cavity enclosed by the shell 110. The top cover assembly 200 includes a heating top cover 210 and a blocking portion 220. The blocking portion 220 is sleeved on the heating top cover 210. The blocking portion 220 and the housing 100 cooperatively enclose a liquid reservoir for storing the liquid. The heating top cover 210 is provided with an air guiding hole 211 and a guiding passage 212. A lower end of the central post 120 is inserted into the air guiding hole 211, and the central post 120 and the air guiding hole 211 can be in an interference fit. The tip portion 123 is located in the air guiding hole 211, such that the inhaling hole 121 and the air guiding hole 211 are coaxially arranged. In addition, the inhaling hole 121 and the air guiding hole 211 cooperatively form an inhaling passage 11. A central axis of the inhaling passage 11 extends in the vertical direction. The top cover assembly 200 has a first inner surface 211*a* that defines a boundary of the air guiding hole 211. The other portion of the central post 120 abuts against the first inner surface 211*a*, such that the central post 120 and the air guiding hole 211 are in an interference fit. The tip portion 123 of the center post 120 and the first inner surface 211*a* are spaced apart from each other along a direction perpendicular to a central axis of the air guiding hole 211, such that an annular gap 124 is formed between the tip portion 123 and the first inner surface 211*a*.

Figure 8:
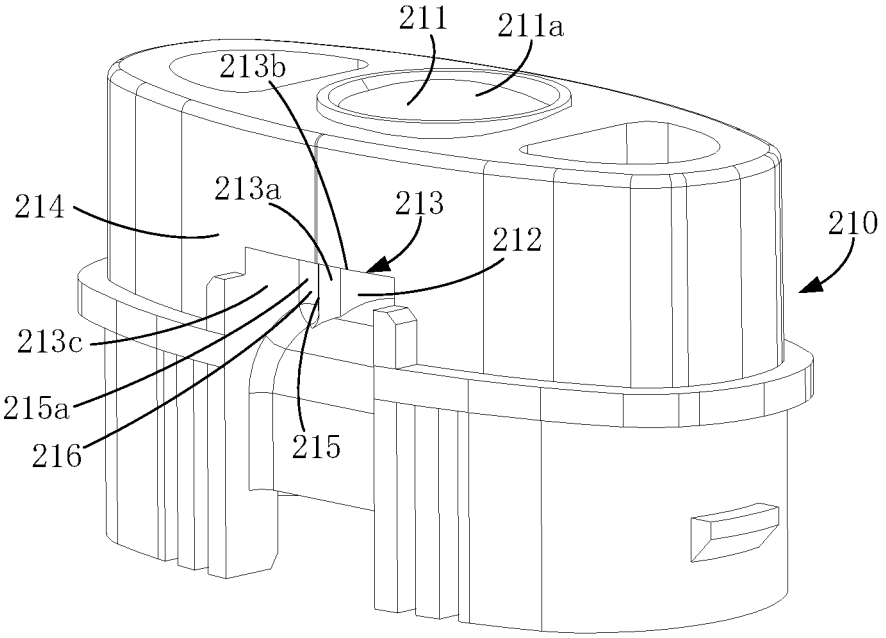
FIG. 8 is a perspective view of a heating top cover of the atomizer shown in FIG. 1 when being upright.
Figure 9:
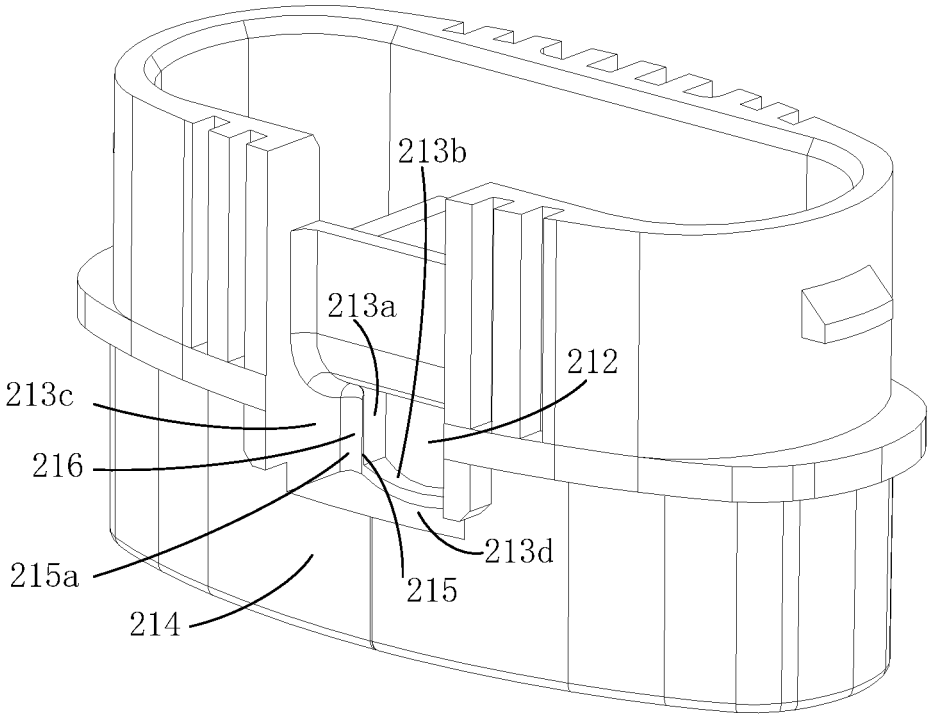
FIG. 9 is a perspective view of a heating top cover of the atomizer shown in FIG. 1 when being inverted.
Figure 10:
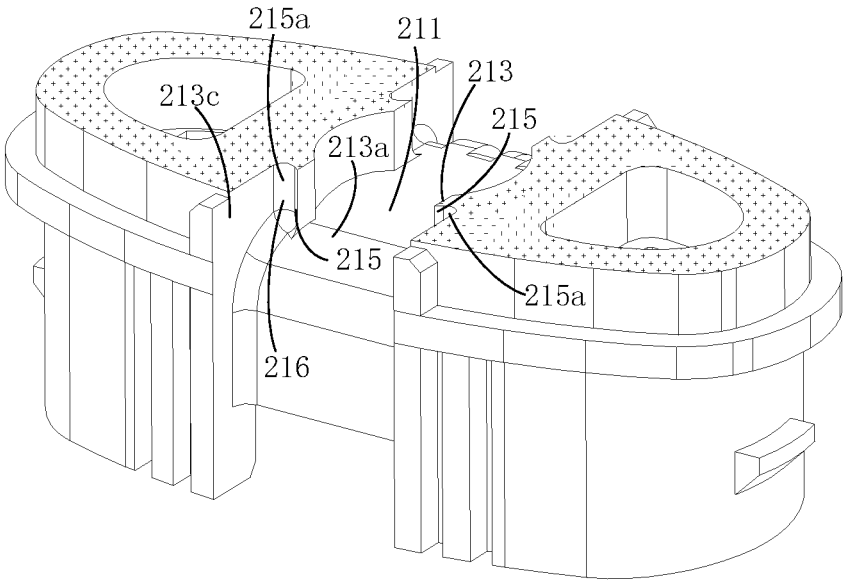
FIG. 10 is a perspective transverse cross-sectional view of a heating top cover of the atomizer shown in FIG. 1.

Referring to FIGS. 8, 9, and 10, the heating top cover 210 has an inner wall surface 213 and an outer wall surface 214. The blocking portion 220 is sleeved on the outer wall surface 214. The inner wall surface 213 defines the boundary of the guiding passage 212. The guiding passage 212 extends through the outer wall surface 214 and the first inner surface 211*a*, such that the guiding passage 212 is in a direct fluid communication with the air guiding hole 211. That is, the air guiding hole 211 is in fluid communication between the guiding passage 212 and the inhaling hole 121. The inner wall surface 213 includes an inner sidewall surface 213*a* and an inner top wall surface 213*b*. Two inner sidewall surfaces 213*a* are provided, which are arranged opposite to each other. The inner top wall surface 213*b* is connected between the two inner sidewall surfaces 213*a*, such that the two inner sidewall surfaces 213*a* are both located on the same side (i.e., the lower side) of the inner top wall surface 213*b*. The inner sidewall surface 213*a* is parallel to the central axis of the inhaling passage 11, and the inner top wall surface 213*b* is perpendicular to the central axis of the inhaling passage 11. In other words, the inner sidewall surface 213*a* extends in a vertical direction, and the inner top wall surface 213*b* extends in a horizontal direction. The central axis of the guiding passage 212 and the central axis of the inhaling passage 11 intersect to form a certain angle. For example, the angle may be 90°. In this case, the inhaling passage 11 extends in the vertical direction, and the guiding passage 212 extends in the horizontal direction.

Figure 11:
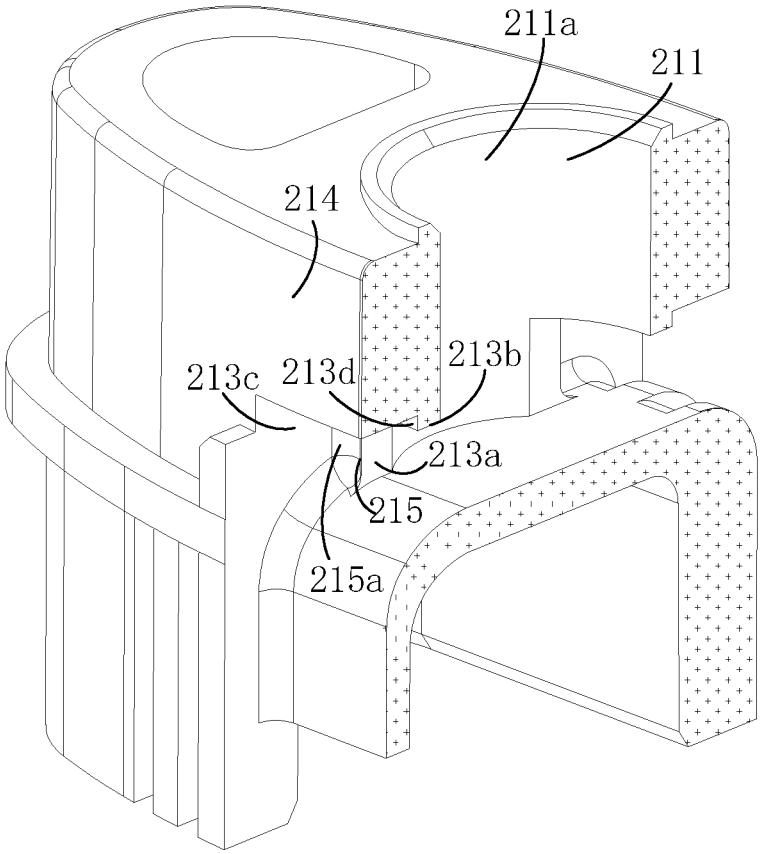
FIG. 11 is a perspective longitudinal cross-sectional view of a heating top cover of the atomizer shown in FIG. 1.
Figure 12:
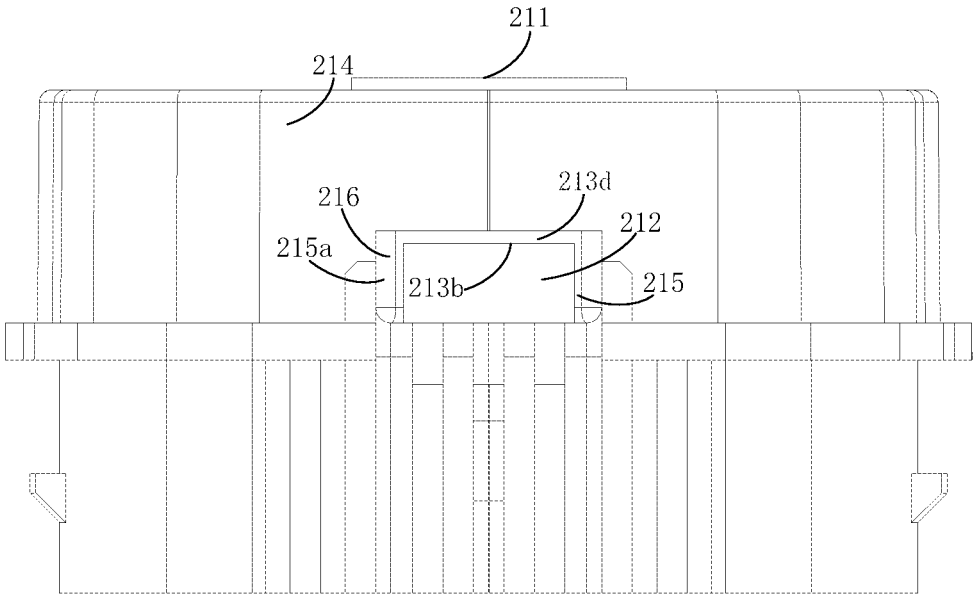
FIG. 12 is a front view of a heating top cover of the atomizer shown in FIG. 1.
Figure 13:
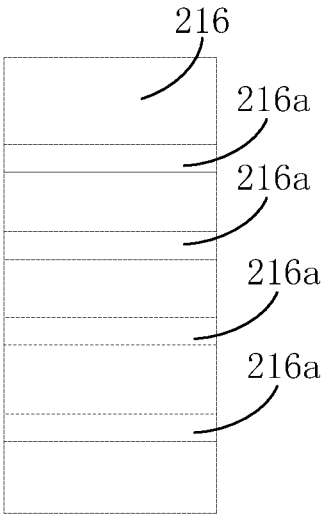
FIG. 13 is a partial plane view of a heating top cover of the atomizer shown in FIG. 1.

Referring to FIGS. 9, 11, and 12, a part of the inner sidewall surface 213*a* away from the air guiding hole 211 is recessed in a left-and-right direction to form a first groove 213*c*, which extends through the outer wall surface 214. The heating top cover 210 further has a first inner bottom wall surface 215, which can define a part of a boundary of the first groove 213*c*. The first inner bottom wall surface 215 is connected to a portion of the inner sidewall surface 213*a* that is not recessed and adjacent to the air guiding hole 211. The first inner bottom wall surface 215 is recessed in a front-and-rear direction to form a second groove 215*a*. The first groove 213*c* and the second groove 215*a* are in fluid communication with each other, and the extending directions of the two can form a certain angle, for example, 90°. The heating top cover 210 further has a second inner bottom wall surface 216. The second inner surface 122 defines a part of a boundary of the second groove 215*a*. The second inner bottom wall surface 216 is recessed in the front-and-rear direction to form a micro-groove 216*a*. A width of the micro-groove 216*a* is less than a width of the second groove 215*a*. An extending direction of the micro-groove 216*a* forms an angle with the central axis of the inhaling passage 11. For example, referring to FIG. 13, the extending direction of the micro-groove 216*a* and the central axis of the inhaling passage 11 are substantially perpendicular to each other. In this case, the extending direction of the micro-groove 216*a* is the horizontal direction. In other embodiments, the extending direction of the micro-groove 216*a* can form an acute angle with the central axis of the inhaling passage 11. In this case, the extending direction of the micro-groove 216*a* forms a certain inclined angle with the horizontal direction. A plurality of micro-grooves 216*a* may be provided. The plurality of micro-grooves 216*a* are arranged on the second inner bottom wall surface 216 at intervals. A part of the inner top wall surface 213*b* away from the air guiding hole 211 is recessed upward to form a third groove 213*d*. The third groove 213*d* also extends through the outer wall surface 214.

The first groove 213*c*, the second groove 215*a*, the third groove 213*d*, and the micro-groove 216*a* are recessed structures formed on the inner wall surface 213. Obviously, the abovementioned recessed structures are located between the guiding passage 212 and the air guiding hole 211. In other embodiments, protrusions can also be provided on the inner wall surface 213 to form a protruding structure.

Figure 7:
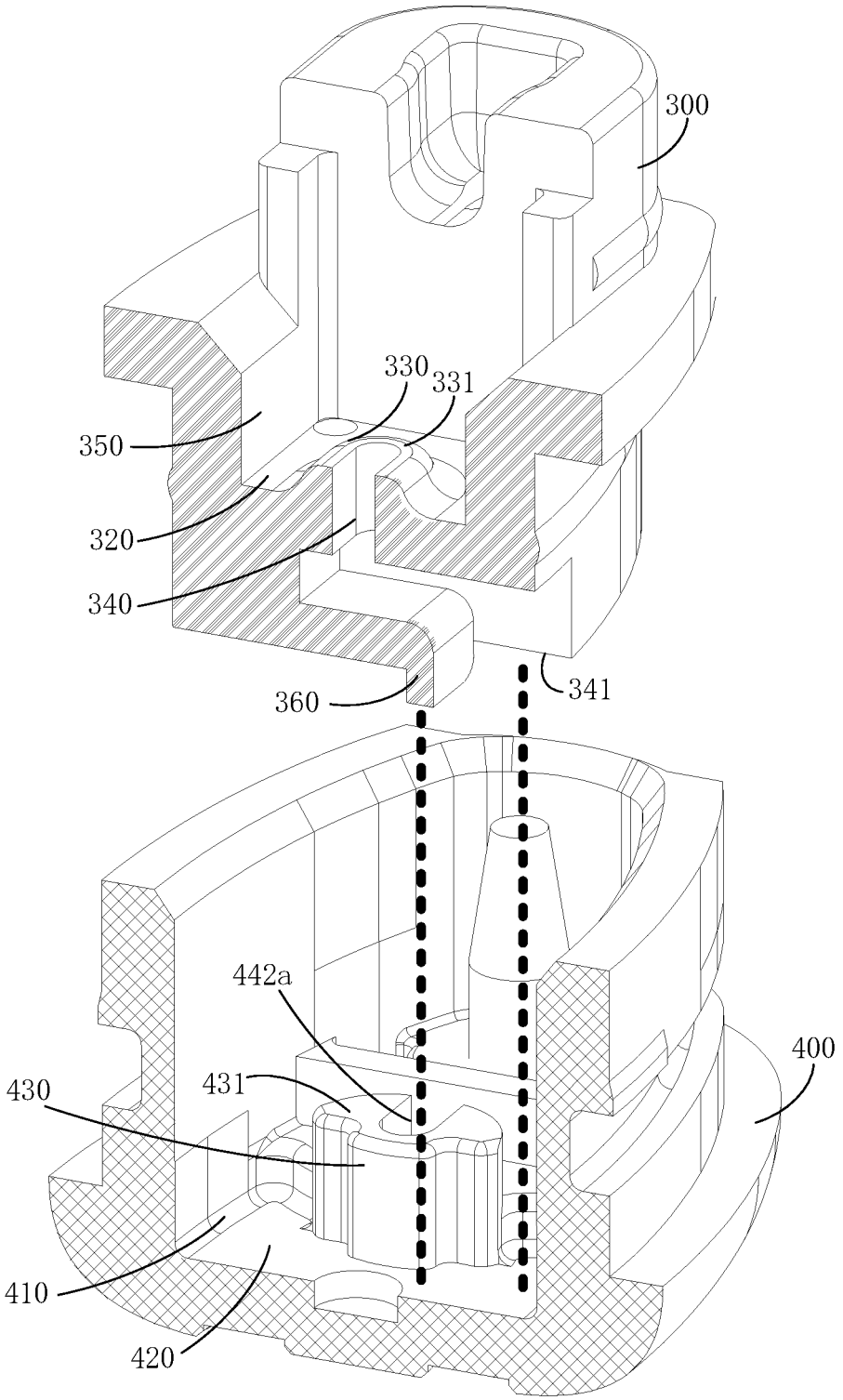
FIG. 7 is a perspective partial exploded cross-sectional view of the atomizer shown in FIG. 1.

Referring to FIGS. 4, 6, and 7, the sealing member 300 is connected to the heating top cover 210. The sealing member 300, the heating top cover 210, and the shell 110 cooperatively enclose a liquid directing passage 12. The liquid directing passage 12 is in fluid communication with the guiding passage 212, and the atomizing core 510 is at least partially located in the liquid directing passage 12. The atomizing core 510 is located outside the inhaling passage 11 and the guiding passage 212. The atomizing core 510 may include a liquid guiding element and a heating element. The liquid guiding element may be a columnar structure made of cotton material. The heating element may be made of metal material. The heating element is electrically connected to the power supply. When the power supply supplies power to the heating element, the heating element can convert the electrical energy into the heat. The heating element can be in a spiral shape, and the heating element is spirally wound on the liquid guiding element. The liquid guiding element is used to absorb the liquid in the liquid reservoir. When the heating element is energized, the generated heat can atomize the liquid on the liquid guiding element to form the aerosol. The aerosol can be discharged into the directing passage 12.

In other embodiments, the liquid guiding element can be made of porous ceramic, and the heating element is attached to a surface of the porous ceramic. The porous ceramic can absorb the liquid in the liquid reservoir through the capillary action of the micropores. When the heating element is energized, the liquid on the porous ceramic can be atomized to generate the aerosol.

Figure 16:
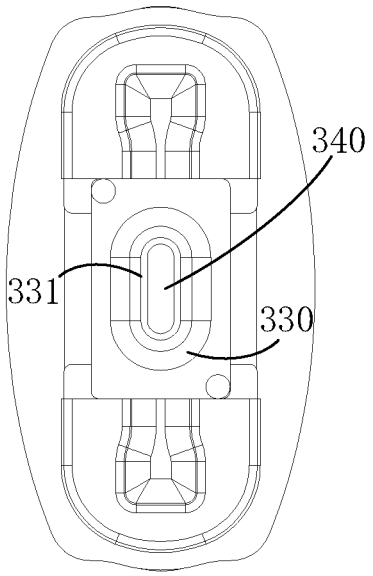
FIG. 16 is a top view of a sealing member of the atomizer shown in FIG. 1.
Figure 17:
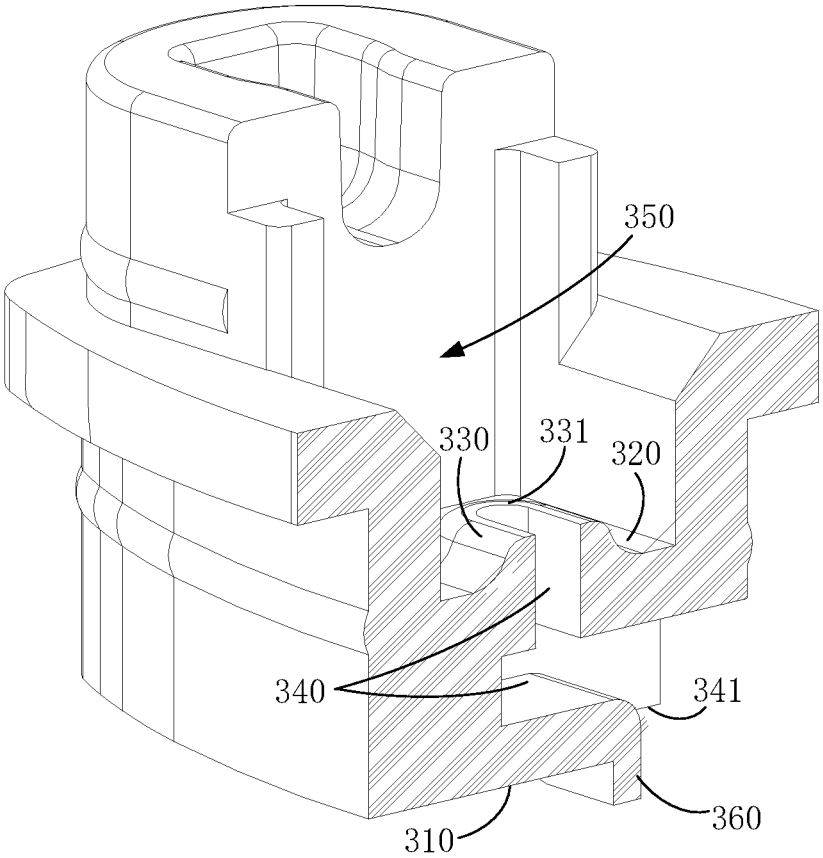
FIG. 17 is a perspective cross-sectional view of a sealing member of the atomizer shown in FIG. 1.

The directing passage 12 includes an atomizing cavity 350 and a directing hole 340. The atomizing cavity 350 is formed by the sealing member 300, the heating top cover 210, and the shell 110. The atomizing core 510 is at least partially located in the atomizing cavity 350. The aerosol generated by the atomizing core 510 is discharged into the atomizing cavity 350. Referring to FIGS. 16 and 17, the directing hole 340 is provided on the sealing member 300. The sealing member 300 has a mounting surface 310 and a connecting surface 320. The connecting surface 320 faces upward, and the mounting surface 310 faces downward. That is, the connecting surface 320 faces away from the mounting surface 310. The connecting surface 320 defines a part of the boundary of the atomizing cavity 350. The sealing member 300 includes a boss 330 located in the atomizing cavity 350. A lower end of the boss 330 is fixed to the connecting surface 320. An upper end of the boss 330 protrudes from the connecting surface 320 by a certain height. The boss 330 has a free end surface 331 at the upper end thereof. The free end surface 331 and the connecting surface 320 are spaced apart in the vertical direction. In other words, the free end surface 331 is higher than the connecting surface 320 in the vertical direction. The upper end of the directing hole 340 extends upwardly through the free end surface 331, such that the directing hole 340 is in fluid communication with the atomizing cavity 350. The lower end of the directing hole 340 extends laterally through the mounting surface 310 to form an input port 341.

Figure 18:
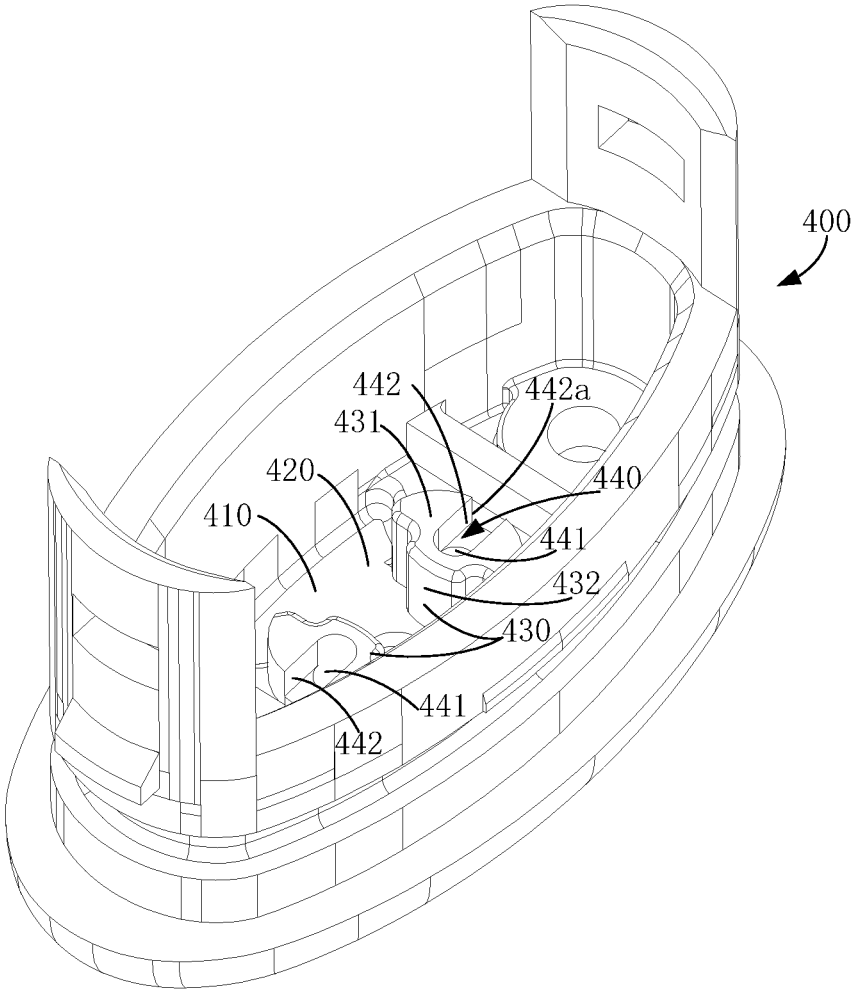
FIG. 18 is a perspective view of a base of the atomizer shown in FIG. 1.

Referring to FIGS. 6, 18, and 17, at least a part of the base 400 is received in the cavity enclosed by the housing 110. The sealing member 300 is provided on the base 400. The sealing member 300 and the base 400 cooperatively enclose an air guiding cavity 410. The mounting surface 310 define a part of the boundary of the air guiding cavity 410. Since the input port 341 is located on the mounting surface 310, the directing hole 340 is in a direct fluid communication with the air guiding cavity 410.

Figure 14:
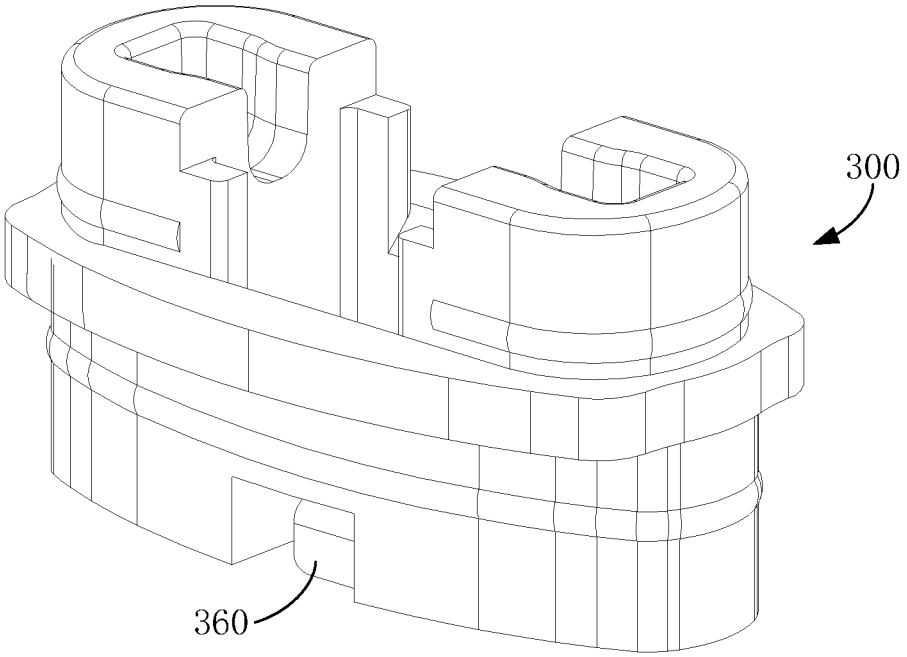
FIG. 14 is a perspective view of a sealing member of the atomizer shown in FIG. 1 when being upright.
Figure 15:
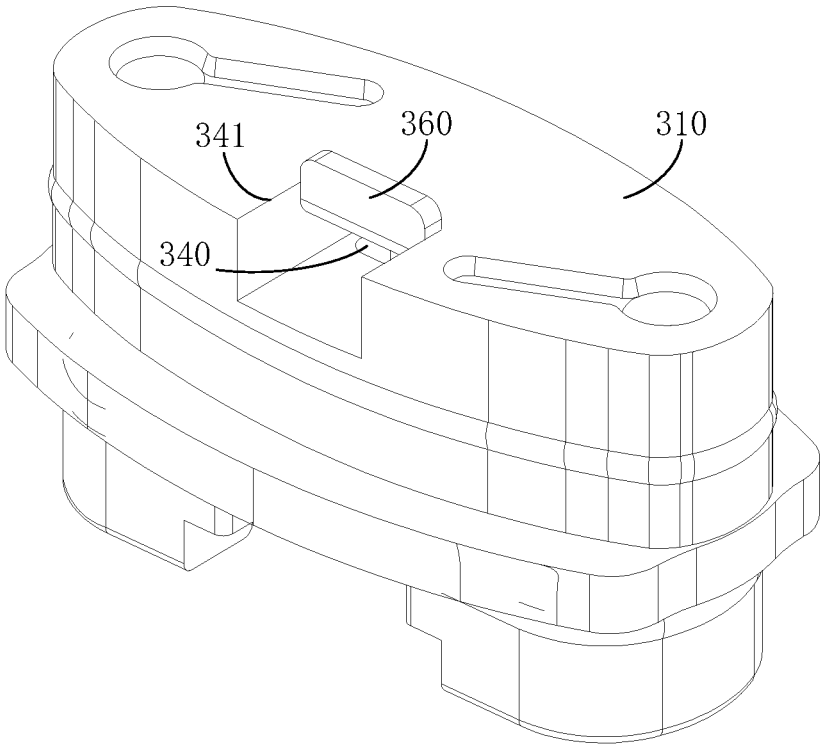
FIG. 15 is a perspective view of a sealing member of the atomizer shown in FIG. 1 when being inverted.

Referring to FIGS. 14 and 15, the flow guiding member 360 is substantially plate-shaped. The flow guiding member 360 is connected to the mounting surface 310 and is located on an edge of the input port 341. The flow guiding member 360 is used to transfer the liquid from the input port 341, and transfer the liquid into the air guiding cavity 410. The liquid absorbing member 520 is located in the air guiding cavity 410. The liquid output by the flow guiding member 360 can be absorbed by the liquid absorbing member 520, so as to prevent the liquid from flowing freely in the air guiding cavity 410. The base 400 is provided with an air inlet 441. The air inlet 441 is in fluid communication with the outside atmosphere and the air guiding cavity 410.

Figure 19:
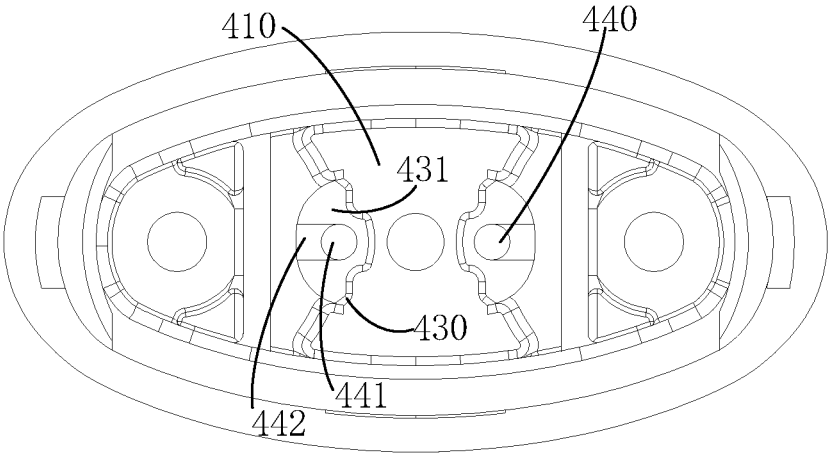
FIG. 19 is a top view of a base of the atomizer shown in FIG. 1.
Figure 20:
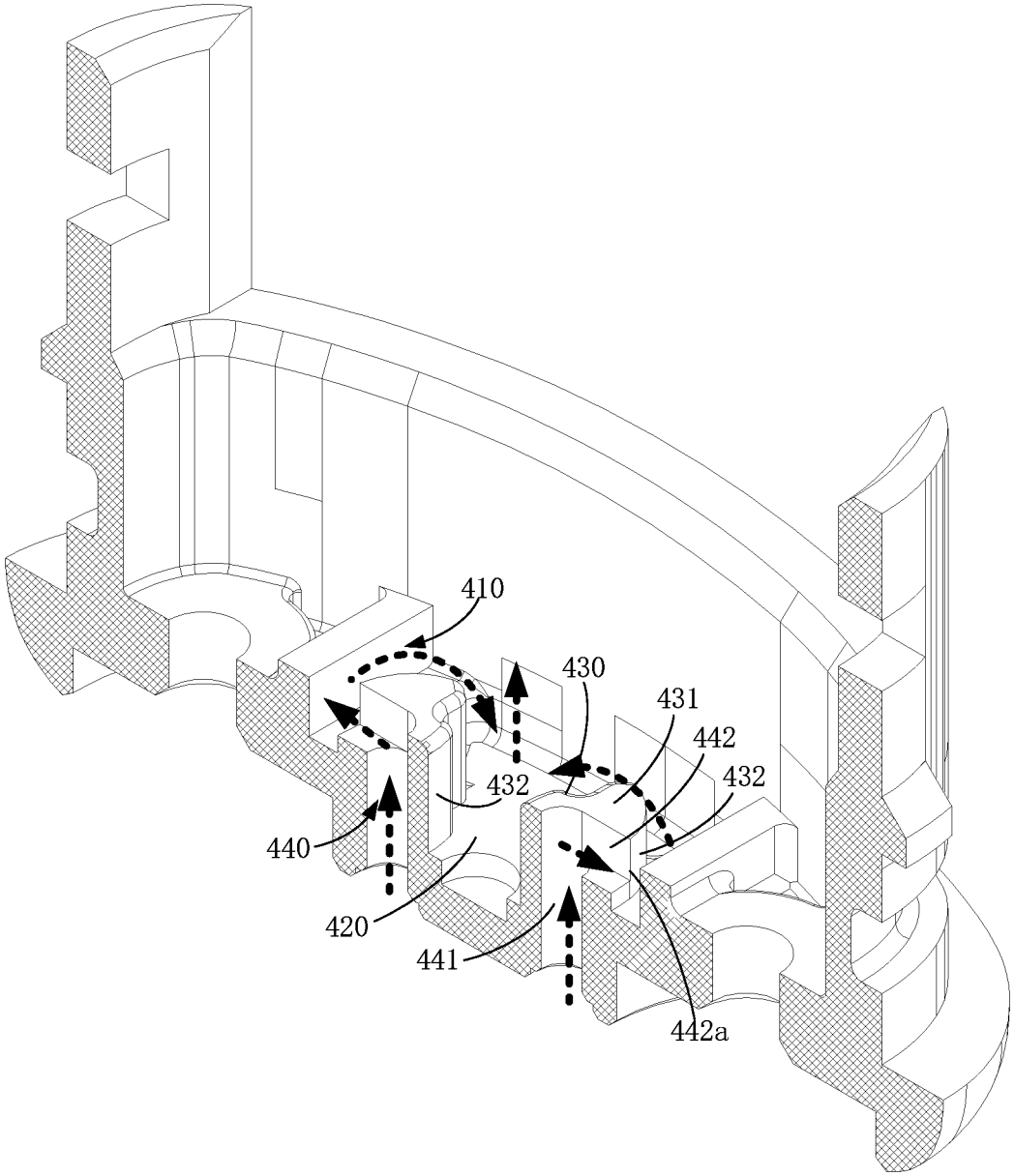
FIG. 20 is a perspective cross-sectional view of a base of the atomizer shown in FIG. 1.

Referring to FIGS. 18, 19, and 20, the base 400 has a fixing surface 420 facing the mounting surface 310. The fixing surface 420 defines a part of the boundary of the air guiding cavity 410. The base 400 further includes a protruding post 430 located in the air guiding cavity 410. A lower end of the protruding post 430 is a fixed end and is fixed to the fixing surface 420. An upper end of the protruding post 430 is a free end and protrudes from the fixed surface 420 by a certain height. The base 400 is provided with an air inlet channel 440. At least a part of the air inlet channel 440 is located in the protruding post 430. The air inlet channel 440 has an output port **442*a* allowing the air to flow out. The output port 442*a* is located on the protruding post 430. The air inlet channel 440 is in a direct fluid communication with the air guiding cavity 410 via the output port 442*a*. A certain distance is kept between the output port 442*a* and the fixed surface 420. In other words, the output port 442*a* is higher than the fixing surface 420** in the vertical direction.

In the illustrated embodiment, the protruding post 430 has a top surface 431 and a side surface 432. The side surface 432 extends vertically and is connected to the top surface 431. The top surface 431 and the fixed surface 420 are spaced apart from each other in the vertical direction. The top surface 431 faces upward. The side surface 432 is connected between the top surface 431 and the fixed surface 420. The air inlet channel 440 includes the air inlet 441 and an output groove 442. The air inlet 441 is in fluid communication with the outside atmosphere. The output groove 442 is in fluid communication with the air guiding cavity 410 and the air inlet 441. The output groove 442 extends through the side surface 432 and the top surface 431. The output port **442*a* is located on the output groove 442. Specifically, when the sealing member 300 is provided on the base 400, the mounting surface 310 of the sealing member 300 is attached to and abuts against the top surface 431 of the protruding post 430, such that the mounting surface 310 blocks an opening of the output groove 442 on the top surface 431. In this case, the opening of the output groove 442 on the side surface 432 can form the output port 442*a***.

In other embodiments, for example, the mounting surface 310 may be spaced apart from the top surface 431. That is, the mounting surface 310 does not cover the opening of the output groove 442 on the top surface 431. In this case, the openings of the output groove 442 on the top surface 431 and on the side surface 432 cooperatively form the output port **442*a*. For another example, the output groove 442 may only extend through the top surface 431. The opening of the output groove 442 on the top surface 431 forms the output port 442*a*. Since the top surface 431 is a horizontal surface, the output port 442*a* is arranged horizontally. For another example, the output groove 442 may only extend through the side surface 432, and the opening of the output groove 442 on the side surface 432 forms the output port 442*a*. Since the side surface 432 is a vertical surface, the output port 442*a*** is arranged vertically.

Referring to FIGS. 3 and 7, in some embodiments, a plane perpendicular to the axial direction of the atomizer 10 is referred as a reference plane. The reference plane is perpendicular to the central axis of the inhaling passage 11. That is, the reference plane is a horizontal plane. A distance between the orthographic projections of the input port 341 and the output port **442*a* on the reference plane is greater than zero. In other words, the input port 341 is offset from the output port 442*a* in the horizontal direction. Similarly, a distance between the orthographic projections of the flow guiding member 360 and the output port 442*a* on the reference plane is greater than zero. In other words, the flow guiding member 360 is offset from the output port 442*a* in the horizontal direction. Two dashed lines in FIG. 7 are the projections' trajectories of the input port 341 and the flow guiding member 360 on the reference plane, respectively. A distance between the orthographic projections of the flow guiding member 360 and the directing hole 340 on the reference plane is greater than zero, such that the flow guiding member 360 is offset from the directing hole 340**.

When the user inhales at the nozzle 121*a*, the outside air flows through the air inlet channel 440, the air guiding cavity 410, and the directing hole 340 successively and enters the atomizing cavity 350 to carry the aerosol. Then, the air carrying the aerosol can flow through the guiding passage 212, the air guiding hole 211, and the inhaling hole 121 successively and reaches the nozzle 121*a*, such that the aerosol is inhaled by the user. The dashed arrows in FIG. 4, FIG. 6 and FIG. 20 indicate the flow trajectory of the air.

Generally, when the atomizer 10 is out of use, the aerosol remained in the atomizing cavity 350 can be liquefied to form a condensate. While a seeping liquid can be formed on the atomizing core 510, and the seeping liquid can drop from the atomizing core 510. The seeping liquid and the condensate together form the leakage liquid. Since the sealing member 300 includes a boss 330 located in the atomizing cavity 350, and the boss 330 protrudes from the connecting surface 320. A part of the leakage liquid can be attached to the connecting surface 320. That is, the leakage liquid can be stored in a recessed space of the atomizing cavity 350 located on the edge of the boss 330. The directing hole 340 extends through the free end surface 331 of the boss 330 and is in fluid communication with the atomizing cavity 350, such that the leakage liquid stored in the recessed space is difficult to reach the free end surface 331, thus preventing the leakage liquid from entering the directing hole 340, and ensuring that the recessed space in the atomizing cavity 350 can effectively store the leakage liquid.

Sometimes a part of the seeping liquid will drop directly into the directing hole 340, and some aerosol can enter the directing hole 340 from the atomizing cavity 350. This part of the aerosol can also be liquefied in the directing hole 340 to form the condensate. In short, a part of the leakage liquid cannot be stored in the recessed space, but can be transferred from the directing hole 340 to the flow guiding member 360 via the input port 341, such that the leakage liquid on the flow guiding member 360 can eventually drop onto the liquid absorbing member 520. Since the flow guiding member 360 is offset from the output port 442*a* in the horizontal direction, the leakage liquid dropped from the flow guiding member 360 cannot fall into the output port 442*a*. As such, the leakage liquid is prevented from leaking out from the atomizer 10 via the air inlet channel 440 to enter the power supply, thus preventing the leakage liquid from corroding the power supply or even causing the power supply to explode, thereby improving the service life and safety of the power supply. In addition, the input port 341 is also offset from the output port 442*a* in the horizontal direction. Even if a part of the leakage liquid cannot enter the flow guiding member 360 and drops directly from the input port 341, it can effectively prevent the leakage liquid dropped from the input port 341 from directly entering the output port 442*a*, thereby effectively avoiding the leakage liquid from leaking out of the atomizer 10 via the air inlet channel 440. Since the side surface 432 can be vertically connected to the top surface 431, when the output port 442*a* is located above the side surface 432 that is vertically arranged, the output port 442*a* can be arranged vertically. Even if the output port 442*a* is not offset from the input port 341, when the leakage liquid drops from the input port 341, the dropped leakage liquid is difficult to enter the output port 442*a*.

After the flow guiding member 360 guides the leakage liquid into the air guiding cavity 410, the leakage liquid can be stored in the recessed space at the edge of the protruding post 430. Since a certain distance is kept between the output port 442*a* and the fixed surface 420, that is, the height of the output port 442*a* is higher than that of the fixed surface 420, it can ensure that the leakage liquid in the recessed space cannot reach the output port 442*a*, thus avoiding the leakage liquid from leaking via the air inlet channel 440. Further, the liquid absorbing member 520 can be fixed on the fixing surface 420 of the base 400. The leakage liquid on the flow guiding member 360 can be directly input to the liquid absorbing member 520. Due to the absorption and restraining effect of the liquid absorbing member 520, it can effectively prevent the liquid from flowing freely in the air guiding cavity 410, thereby preventing the liquid level in the recessed space in the air guiding cavity 410 from reaching the output port 442*a*.

When the user inhales at the nozzle 121*a*, subjected to the negative pressure, the condensate and non-liquefied suspended droplets in the atomizing cavity 350 can flow into the guiding passage 212. In this case, due to the recessed structures such as the first groove 213*c*, the second groove 215*a*, the third groove 213*d* and the micro-groove 216*a*, the recessed structures can obstruct and adsorb the leakage liquid formed by the condensate and suspended droplets, such that the leakage liquid is received in the recessed structures and is difficult to enter the inhaling passage 11, thus preventing the user from inhaling the leakage liquid into the mouth. In addition, since the annular gap 124 is formed between the tip portion 123 of the central post 120 and the first inner surface 211*a*, even if the leakage liquid enters the air guiding hole 211 from the guiding passage 212, the annular gap 124 can receive and obstruct the leakage liquid, thus preventing the leakage liquid from entering the nozzle 121*a* to be inhaled by the user. Furthermore, since the receiving groove 122*a* is formed on the second surface of the center post 120, even if the leakage liquid enters the air inlet 441 via the air guiding hole 211, the receiving groove 122*a* can receive and obstruct the leakage liquid to prevent the leakage liquid from entering the nozzle 121*a* to be inhaled by the user. Therefore, due to the triple obstruction of the recessed structures on the inner wall surface 213, the annular gap 124, and the receiving groove 122*a*, the leakage liquid can be effectively prevented from being inhaled by the user.

When the atomizer 10 is tilted or inverted, the nozzle 121*a* faces downward, and the condensate in the atomizing cavity 350 and the seeping liquid dropping from the atomizing core 510 into the atomizing cavity 350 will form the leakage liquid. Under the action of gravity, the leakage liquid will flow from the atomizing cavity 350 into the guiding passage 212. Based on the similar principle, due to the triple obstruction of the recessed structures on the inner wall surface 213, the annular gap 124, and the receiving groove 122*a*, the leakage liquid can be effectively prevented from flowing out of the atomizer 10 via the nozzle 121*a*.

Accordingly, the atomizer 10 can not only effectively prevent the leakage liquid from leaking out of the atomizer 10 via the air inlet channel 440, preventing the leakage liquid from corroding the power supply or causing the power supply to explode, but also can effectively prevent the leakage liquid from leaking out of the atomizer 10 via the nozzle 121*a* of the air inlet channel 11. If the air inlet channel 440, the air guiding cavity 410, the directing passage 12, the guiding passage 212, and the inhaling passage 11 are regarded as an airflow passage through which the outside air flows, the atomizer 10 can prevent the leakage liquid from leaking out of the atomizer 10 via the upper and lower ends of the airflow passage. In addition, it can prevent the condensate and suspended droplets from being inhaled by the user during inhalation, which can improve the user's inhaling experience.

The technical features of the above described embodiments can be combined arbitrarily. To simplify the description, not all possible combinations of the technical features in the above embodiments are described. However, all of the combinations of these technical features should be considered as being fallen within the scope of the present disclosure, as long as such combinations do not contradict with each other.

The foregoing embodiments merely illustrate some embodiments of the present disclosure, and descriptions thereof are relatively specific and detailed. However, it should not be understood as a limitation to the patent scope of the present disclosure. It should be noted that, a person of ordinary skill in the art may further make some variations and improvements without departing from the concept of the present disclosure, and the variations and improvements falls in the protection scope of the present disclosure. Therefore, the protection scope of the present disclosure shall be subject to the appended claims.

What is claimed is:

1. An atomizer, comprising:

an atomizing core;

a base provided with an air inlet channel;

a sealing member located between the base and the atomizing core, the sealing member being provided with a directing hole configured to guide air into the atomizing core; and a flow guiding member connected to the sealing member;

wherein taking a plane perpendicular to an axial direction of the atomizer as a reference plane, a distance between orthographic projections of the flow guiding member and the directing hole on the reference plane is greater than zero, wherein the flow guiding member is located on a side of the sealing member and is spaced from the atomizing core;

wherein the base and the sealing member cooperatively enclose an air guiding cavity in fluid communication with the air inlet channel and the directing hole, respectively, and the flow guiding member is located in the air guiding cavity and introduces liquid into the air guiding cavity;

wherein the air inlet channel forms an output port at an end thereof allowing the air to flow out, the directing hole forms an input port at an end thereof allowing the air to flow in, the air entering the air inlet channel enters the input port through the output port, and a distance between orthographic projections of the input port and the output port on the reference plane is greater than zero;

wherein the base has a fixing surface facing the sealing member and defining part of a boundary of the air guiding cavity, the base further comprises a protruding post located in the air guiding cavity, the protruding post is connected to the fixing surface and protrudes from the fixing surface, at least a part of the air inlet channel is provided in the protruding post, and the output port is provided on the protruding post and maintains a distance from the fixing surface;

wherein the protruding post has a top surface and a side surface that are spaced apart, the side surface is connected between the top surface and the fixing surface, the air inlet channel comprises an air inlet and an output groove, the air inlet is in fluid communication with an outside atmosphere, the output groove extends through the side surface and the top surface, and the output port is located in the output groove; and wherein the top surface abuts against the sealing member and covers an opening of the output groove located on the top surface, and the output port is formed by an opening of the output groove located on the side surface.

2. The atomizer according to claim 1, wherein the side surface and the top surface are perpendicular to each other.

3. The atomizer according to claim 1, wherein the sealing member is further provided with an atomizing cavity in fluid communication with the directing hole, the atomizing core is at least partially located in the atomizing cavity, the sealing member has a connecting surface facing the atomizing core and defining part of a boundary of the atomizing cavity, the sealing member comprises a boss located in the atomizing cavity, the boss is connected to the connecting surface and protrudes from the connecting surface, the boss has a free end surface spaced apart from the connecting surface, and one end of the directing hole extends through the free end surface.

4. The atomizer according to claim 1, further comprising a liquid absorbing member located in the air guiding cavity, and the flow guiding member introducing the liquid to the liquid absorbing member.

5. The atomizer according to claim 1, wherein the atomizing core comprises a liquid guiding element located on the sealing member and a heating element spirally sleeved on the liquid guiding element.

6. An electronic atomizing device, comprising a power supply and the atomizer according to claim 1 electrically connected to the power supply.

7. The atomizer according to claim 1, wherein the atomizing core is configured to convert electrical energy into heat when electrically connected to a power supply.

8. The atomizer according to claim 1, wherein the flow guiding member transfers liquid from an input port and transfer the liquid into an air guiding cavity.

* * * * *